US009309479B2

(12) United States Patent
Schweigkofler et al.

(10) Patent No.: US 9,309,479 B2
(45) Date of Patent: Apr. 12, 2016

(54) LUBRICATING GREASE BASED ON PERFLUOROPOLYETHER

(75) Inventors: Martin Schweigkofler, Friedberg (DE); Martin Schmidt-Amelunxen, Rhormoos/Arzbach (DE)

(73) Assignee: Kluber Lubrication Munchen SE & Co. KG, Munich (DE)

( * ) Notice: Subject to any disclaimer, the term of this patent is extended or adjusted under 35 U.S.C. 154(b) by 168 days.

(21) Appl. No.: 14/126,470

(22) PCT Filed: May 25, 2012

(86) PCT No.: PCT/EP2012/002254

§ 371 (c)(1), (2), (4) Date: Feb. 19, 2014

(87) PCT Pub. No.: WO2012/171611

PCT Pub. Date: Dec. 20, 2012

(65) Prior Publication Data

US 2014/0155306 A1 Jun. 5, 2014

(30) Foreign Application Priority Data

Jun. 17, 2011 (DE) ..... 10 2011 104 507

(51) Int. Cl.

| | |
|---|---|
| ***C10M 107/38*** | (2006.01) |
| ***C10M 113/12*** | (2006.01) |
| ***C10M 125/26*** | (2006.01) |
| ***C10M 131/10*** | (2006.01) |
| ***C10M 169/02*** | (2006.01) |
| ***C10M 105/50*** | (2006.01) |
| ***C10M 129/26*** | (2006.01) |

(52) U.S. Cl.

CPC ..... *C10M 131/10* (2013.01); *C10M 105/50* (2013.01); *C10M 113/12* (2013.01); *C10M 125/26* (2013.01); *C10M 129/26* (2013.01); *C10M 169/02* (2013.01); *C10M 2201/1056* (2013.01); *C10M 2213/0606* (2013.01); *C10M 2213/0626* (2013.01); *C10N 2230/76* (2013.01); *C10N 2240/02* (2013.01); *C10N 2240/202* (2013.01); *C10N 2250/10* (2013.01)

(58) Field of Classification Search

CPC ..... C10M 113/12; C10M 2201/1056; C10M 2213/0606; C10M 125/26; C10M 2201/102; C10M 2201/105; C10M 2213/06; C10M 2213/062; C10M 2213/0623; C10M 105/54; C10N 2250/10

USPC ..... 508/579.582

See application file for complete search history.

(56) References Cited

U.S. PATENT DOCUMENTS

| | | | | |
|---|---|---|---|---|
| 6,753,301 | B2 * | 6/2004 | Howell | C10M 107/38 252/380 |
| 2003/0027732 | A1 | 2/2003 | Howell et al. | |
| 2004/0142604 | A1 * | 7/2004 | Ladin et al. | 439/783 |
| 2004/0198612 | A1 | 10/2004 | Asao et al. | |
| 2006/0281641 | A1 * | 12/2006 | MacCone | 508/182 |
| 2007/0049502 | A1 * | 3/2007 | Howell et al. | 508/182 |
| 2008/0167208 | A1 * | 7/2008 | Hashida et al. | 508/582 |
| 2010/0105584 | A1 * | 4/2010 | Avataneo et al. | 508/155 |
| 2012/0149613 | A1 * | 6/2012 | David et al. | 508/144 |

FOREIGN PATENT DOCUMENTS

| | | | |
|---|---|---|---|
| JP | 2000104091 A | * | 4/2000 |
| JP | 2008120926 A | | 5/2008 |
| WO | WO 2011015337 A2 | * | 2/2011 |

OTHER PUBLICATIONS

"PFPE, a Unique Lubricant for a Unique Application" Mahmoud A Fowzy (1998).*

European Search Report in European application EP2012002254, mailed Jan. 3, 2014.

* cited by examiner

*Primary Examiner* — Pamela H Weiss

(74) *Attorney, Agent, or Firm* — Maginot, Moore & Beck, LLP

(57) ABSTRACT

A lubricating grease is provided that comprises 90 to 99.45 percent by mass of perfluoropolyethers (PFPE) and 0.5 to 5 percent by mass of fumed silica.

5 Claims, No Drawings

LUBRICATING GREASE BASED ON PERFLUOROPOLYETHER

The invention relates to an essentially thickener-free lubricating grease consisting of perfluoropolyethers (PFPE) and a small proportion of a fumed silica, and customary additives.

Perfluorinated polyethers (PFPE) are polymers having good lubrication properties, which are liquid at room temperature and have low surface energies. PFPE compounds are used in virtually all sectors of industry for lubrication, for example in the electronics industry, in aerospace and in the semiconductor industry. PFPE compounds are also used for lubrication of highly stressed ball bearings.

PFPE-based lubricating greases have been thickened using PTFE (Teflon powder), BN (boron nitride), graphite, $MoS_2$, oxidic ceramic materials or organic thickeners, such as ureas and soaps, in concentrations of 20 to 40 percent by mass. Aerosils have likewise been used as individual thickeners or thickener components within the concentration range mentioned. PFPE-based lubricants thickened in this way typically have too high a solids content and their grains are too coarse to work with low noise.

In addition, PFPE lubricants are employed as antisqueak agents, especially on elastomer and textile surfaces, and leather. Here, however, there is unwanted penetration or diffusion of lubricant into the surface of the materials treated, and so regular relubrication becomes necessary.

In order to exploit the advantageous effects of the PFPE compounds as lubricating greases, it was therefore the aim of the present invention to provide an additive which has highly thickening properties in very low concentrations. It is thus possible to serve low-noise applications. The consistent state of the lubricant applied additionally reduces regularity of relubrication on porous material.

The addition of less than 4 percent by mass of fumed silica to PFPE compounds gives consistent lubricating greases. They have NLGI penetration values of 210 to 385 and thus belong to NLGI classes 0 to 3. The additives used may be either hydrophilic or hydrophobic fumed silicas, preference being given to the hydrophilic fumed silicas.

Compared to the known PFPE lubricating greases, the inventive PFPE greases having a very small proportion of fumed silica are superior to the known greases both in terms of their noise characteristics and in terms of their dynamic characteristics. Emphasis should also be given to the transparency of these lubricating greases, which appear visually neutral, for example, on black surfaces.

The surface protection achieved on the surfaces treated with the inventive PFPE lubricating grease is distinctly improved, since it has been shown that the inventive grease is immobilized and does not diffuse into the surface. For this purpose, studies have been conducted on corresponding elastomers and textile surfaces which are used in automobile interiors.

In the case of use of less than 2 percent by mass of fumed silica in the PFPE lubricating grease, the lubricating greases are substantially transparent. A thin lubricating film applied to black surfaces is therefore visually neutral and does not differ from pure PFPE, but has the advantage that the lubricating grease does not penetrate into the surface of the material; see table 1.

Especially in the form of an antisqueak agent in the sector of door seals and door profiles in the automotive sector, these advantages are of particular significance.

TABLE 1

Example formulation for an inventive PFPE lubricant compared to pure PFPE oil.

| | | |
|---|---|---|
| Thickener | 1.5% Aerosil | None |
| PFPE | 100 cSt at 40° C. | 100 cSt at 40° C. |
| Appearance | transparent | transparent |
| Characteristics on EPDM material | Thin lubricant layer applied by brush is unchanged after 7 days. | Thin oil layer applied by brush has substantially diffused into surface after 7 days. |
| Antisqueak characteristics on EPDM material, in-house Kluber test | passed | passed |

It is likewise possible to use the inventive lubricants, on the basis of the properties described above, in electrical contacts, slip rings and switches. PFPE lubricants here, because of their exceptional chemical stability, give very good protective action and prolonged lubricity. In the case of customary solids-based thickeners, the volume resistance in such components can vary impermissibly, since electrically insulating particles hinder current flow. With increasing thickener concentration, this problem increases. The inventive lubricant has two advantages here: the thickener concentration is significantly reduced; in addition, the thickener has a very low mean particle size of less than 1 micrometer. This ensures substantially unhindered current flow; see table 2.

TABLE 2

Properties of an inventive lubricant in electrical contact applications compared to a PTFE-thickened lubricant.

| | | |
|---|---|---|
| Thickener | 2.8% Aerosil | 21% PTFE |
| PFPE | 100 cSt at 40° C. | 100 cSt at 40° C. |
| Characteristics in electrical switch contacts (in-house test) | No variations in passage resistance | Variations in passage resistance after 100 electrical switching operations |

The high-speed properties in roller bearings were confirmed in an SKF-ROF test run; see table 3.

TABLE 3

Properties of an inventive lubricant in roller bearing applications compared to a PTFE-thickened lubricant.

| | | |
|---|---|---|
| Thickener | 3% Aerosil | 24% PTFE |
| PFPE | 300 cSt at 40° C. | 300 cSt at 40° C. |
| Appearance | semitransparent | white |
| Consistency | NLGI 2 | NLGI 2 |
| Speed factor (ROF) | 670000 (good) | 330000 (poor) |
| Service life in roller bearings at 200° C. | >500 h | >500 h |
| FAG MGG 11 noise tester | I (low noise) | IV (poor) |

The inventive lubricating grease contains 90 to 99.45 percent by mass of perfluoropolyether (PFPE) and 0.5 to 5 percent by mass of fumed silica. The perfluoropolyether is a chemical compound of formula (I):

$$R_1—(O—CF_2)_v—(O—C_2F_4)_w—(O—C_3F_6)_x—(O—CFCF_3)_y—(O—CF_2CF(CF_3))_z—O—R_2 \quad (I)$$

where $R_1$ and $R_2$ are identical or different and are selected from $—CF_3$, $—C_2F_5$ and $—C_3F_7$, v, w, x, y, z are integers from ≥0 to 500.

The fumed silica is preferably a hydrophilic silica.

In addition, the inventive lubricating grease may contain 0.05 to 5 percent by mass of anticorrosive.

The anticorrosive present in the lubricating grease is selected from the group consisting of functionalized PFPE derivatives; preference is given to carboxylic acids or metal salts thereof, and PFPE ethoxylates.

The inventive use of lubricating grease is used as an anti-squeak agent in the automotive sector. It is likewise used for lubrication in the office and electronics sectors, especially in the case of plastic hinges of monitors/television mounts or clamshell cell-phones.

The invention claimed is:

1. A lubricating grease consisting of:

90 to 99.45 percent by mass of perfluoropolyethers (PFPE); and 0.5 to 5 percent by mass of fumed silica, in which the fumed silica is a hydrophilic silica, wherein the perfluoropolyethers are a chemical compound of formula (I):

$$R_1—(O—CF_2)_v—(O—C_2F_4)_w—(O—C_3F_6)_x—(O—CFCF_3)_y—(O—CF_2CF(CF_3))_z—O—R_2 \quad (I)$$

where $R_1$ and $R_2$ are identical or different and are selected from $—CF_3$, $—C_2F_5$ and $—C_3F_7$, v, w, x, z are integers from ≥0 to 500 and y is an integer from ≥1 to 500.

2. A lubricating grease consisting of:

90 to 99.45 percent by mass of perfluoropolyethers (PFPE);

0.5 to 5 percent by mass of fumed silica, in which the fumed silica is a hydrophilic silica; and 0.05 to 5 percent by mass of an anticorrosive additive, wherein the perfluoropolyethers are a chemical compound of formula (I):

$$R_1—(O—CF_2)_v—(O—C_2F_4)_w—(O—C_3F_6)_x—(O—CFCF_3)_y—(O—CF_2CF(CF_3))_z—O—R_2 \quad (I)$$

where $R_1$ and $R_2$ are identical or different and are selected from $—CF_3$, $—C_2F_5$ and $—C_3F_7$, v, w, x, z are integers from ≥0 to 500 and y is an integer from ≥0 to 500.

3. The lubricating grease as claimed in claim 2, wherein the anticorrosive is selected from the group consisting of functionalized PFPE derivatives, carboxylic acids or metal salts thereof, and PFPE ethoxylates.

4. The lubricating grease as claimed in claim 1 wherein the lubricating grease is suitable as an antisqueak agent to roller bearings in the automotive sector.

5. The lubricating grease as claimed in claim 1 wherein the lubricating grease is suitable as a lubricant to plastic hinges of monitors/television mounts or clamshell cell phones.

* * * * *